US007206531B2

(12) United States Patent
Suzuki et al.

(10) Patent No.: US 7,206,531 B2
(45) Date of Patent: Apr. 17, 2007

(54) IMAGE FORMING APPARATUS AND METHOD USING LIGHT AND DARK TONERS OF THE SAME HUE

(75) Inventors: Shinya Suzuki, Toride (JP); Takashi Kanno, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 11/018,859

(22) Filed: Dec. 22, 2004

(65) Prior Publication Data

US 2005/0147426 A1 Jul. 7, 2005

(30) Foreign Application Priority Data

Dec. 26, 2003 (JP) ..... 2003-434003

(51) Int. Cl.
*G03G 15/00* (2006.01)

(52) U.S. Cl. ..... 399/49

(58) Field of Classification Search ..... None
See application file for complete search history.

(56) References Cited

U.S. PATENT DOCUMENTS 6,631,249 B2 10/2003 Katsumi et al. ..... 399/71
6,640,077 B2 10/2003 Suzuki et al. ..... 399/303
2001/0028805 A1* 10/2001 Haneda ..... 399/51
2004/0175207 A1* 9/2004 Shoji et al. ..... 399/274

FOREIGN PATENT DOCUMENTS

JP 2000-231279 8/2000

* cited by examiner

*Primary Examiner*—Quana Grainger
(74) *Attorney, Agent, or Firm*—Fitzpatrick, Cella, Harper & Scinto

(57) ABSTRACT

An image forming apparatus includes an image forming section for forming a toner image using light color toner and dark color toner, which have the same hues and which have different densities. A detecting section detects a density of a toner image which is formed for reference by the image forming section. The reference toner image includes a number of portions corresponding to different image density levels. A control section controls an image forming condition of the image forming section in accordance with an output of the detecting section. A difference between the image density levels corresponding to adjacent portions in a density area where an image is formed using both of the light toner and the dark toner is smaller than that in an image density area where an image is formed using only the light toner.

3 Claims, 8 Drawing Sheets

IMAGE FORMING APPARATUS AND METHOD USING LIGHT AND DARK TONERS OF THE SAME HUE

FIELD OF THE INVENTION AND RELATED ART

The present invention relates to an image forming apparatus which forms an image through an electrophotographic process. In particular, it relates to an image forming apparatus such as a copying machine, a printer, a facsimileing machine, or the like.

As an example of an electrophotographic image forming apparatus such as a copying machine, a laser beam printer, etc., a full-color image forming apparatus which forms a full-color image by depositing in layers a plurality of monochromatic images different in color, more specifically, yellow (Y), magenta (M), cyan (C), and black (Bk) images, has been known.

For the formation of a high quality image with use of a full-color image forming apparatus such as the above described one, density control is important, which regulates the apparatus in terms of the maximum and intermediary levels of density for monochromatic yellow (Y), magenta (M), cyan (C), and black (Bk) images so that the apparatus will remain consistent in terms of the image density level, regardless of the difference in manufacture tolerance and changes in ambient conditions. Therefore, it is customary to equip a full-color image forming apparatus with a density controlling means for controlling the apparatus in terms of image density.

There have been proposed various full-color image forming apparatuses equipped with a density detecting means. Some of them (for example, one disclosed in Japanese Laid-open Patent Application No. 2000-231279) are provided with a plurality of image bearing members and a plurality of developing means. Further, at least two of the plurality of developing means are identical in the hue of the developer (toner) therein, but, are different in color density (saturation or deepness) of the developer (toner) therein. The developer in one of the two developing means is the same in hue as the developer in the other developing means, but is lower in color density than the developer in the other developing means. They employ an image forming method in which each of the plurality of monochromatic images formed to form a single full-color image is formed of a combination of two monochromatic images identical in spectral properties, that is, a monochromatic image formed of the abovementioned developer lower in color density level (which hereinafter will be referred to as light color toner), and a monochromatic image formed of the abovementioned developer higher in color density level (which hereinafter will be referred to as deep color toner), using two kinds of lookup tables, that is, a lookup table A for the light color toner, and a lookup table B for the deep color toner, shown in FIG. 10.

According to the lookup tables in FIG. 10, the low density areas of the monochromatic image are primarily formed of the light color toner, and the mid density areas of the monochromatic image are formed of the mixture of the light and deep color toners. Further, the high density areas of the monochromatic image are primarily formed of the deep color toner. Therefore, controlling the image forming apparatus with reference to these lookup tables A and B makes it possible to form an image which does not suffer from the problem that the low density areas of an image appear grainy due to the low dot density, and also to reduce the amount of toner consumed for the formation of the high density areas of an image. In other words, controlling the image forming apparatus with reference to these lookup tables improves the image forming apparatus in terms of image quality by reducing the graininess level at which the low density areas of an image are formed. It is also effective to expand the range in which an image is accurately formed in terms of color reproduction.

However, the above described image forming method suffers from the following problem. That is, in the case of the combination of the above described image forming apparatus and the method it employs, the areas of an image, the color densities of which are in the mid to high range, are formed by transferring the deep color toner, onto the light color toner after the transfer of the light color toner onto a transferring medium, such as an intermediary transfer belt, recording medium, or the like Therefore, the efficiency with which the deep color toner is transferred is sometimes affected by the amount of the electrical charge of the light color toner, and/or the amount by which the light color is borne on the transfer medium. This in turn affects the output of a density sensor Further, the output of the density sensor is also affected by the manner in which the deep color toner is overlaid on the light color toner as the deep color toner is transferred after the transfer of the light color toner.

SUMMARY OF THE INVENTION

The present invention can provide an image forming apparatus capable of forming an image higher in quality than that from an image forming apparatus in accordance with the prior art.

The present invention can also provide an image forming apparatus, which is superior to an image forming apparatus in accordance with the prior art, and which is capable of forming an image superior in the reproduction of the areas of an image formed of the combination of the light and deep color toners.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatuses in accordance with the present invention will be described in detail with reference to the appended drawings.

Embodiment 1

Referring to FIGS. 1–6, the first embodiment of the present invention will be described.

Figure 1:
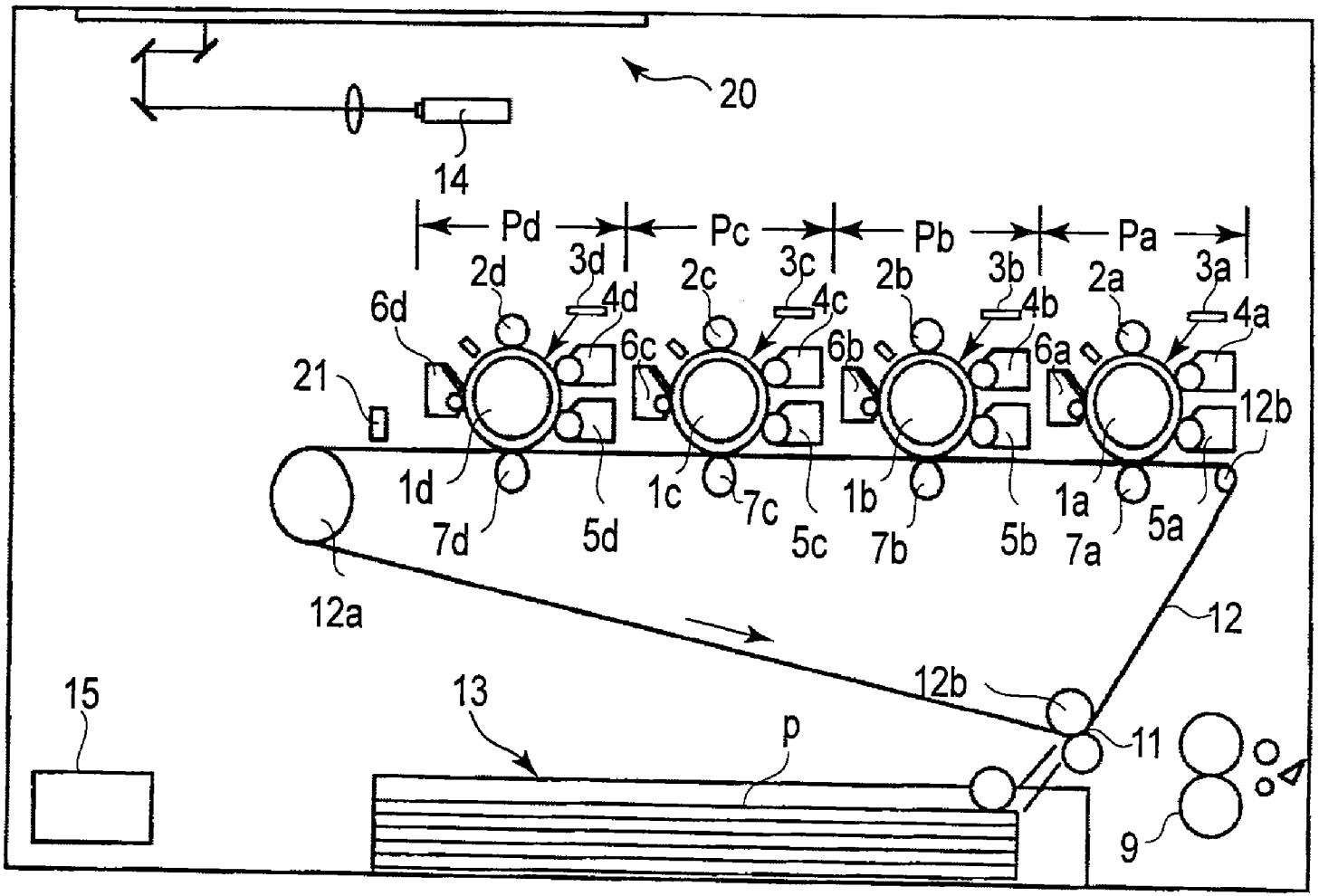
FIG. 1 is a schematic sectional view of the image forming apparatus in the first embodiment of the present invention, showing the general structure thereof.

Referring to FIG. 1, the image forming apparatus in this embodiment has four processing Stations (image forming stations) P (Pa, Pb, Pc, and Pd) as image forming means for forming monochromatic yellow (Y), magenta (M), cyan (C), and black (Bk) images on the four image bearing members, one for one. The four processing stations are aligned straight in the direction in which a recording medium is conveyed. Each processing station has a photosensitive drum I (1*a*, 1*b*, 1*c*, and 1*d*), a charging apparatus 2 (2*a*, 2*b*, 2*c*, and 2*d*), an exposing apparatus 3 (3*a*, 3*b*, 3*c*, and 3*d*), a primary developing means 4 (4*a*, 4*b*, 4*c*, and 4*d*), a secondary developing means 5 (5*a*, 5*b*, 5*c*, and 5*d*), a cleaning apparatus 6 (6*a*, 6*b*, 6*c*, and 6*d*), and a primary transferring means 7 (7*a*, 7*b*, 7*c*, and 7*d*). The image forming apparatus is provided with an intermediary transfer member 12 as a transferring means for transferring, in coordination with the primary transferring apparatuses 7, the toner images onto a recording medium p. The intermediary transfer member 12 is stretched between the photosensitive drum 1 and primary transferring apparatus 7, in each processing station, and is circularly moved in the direction indicated by an arrow mark.

In this image forming apparatus structured as described above, each of the four image forming stations for forming the four monochromatic toner images (that is, the monochromatic yellow (Y), magenta (M), cyan (C), and black (Bk) toner images, one for one) is provided with two developing means, that is, the first and second developing means 4 and 5. Two developing means are provided per color. More specifically, the first and second developing means are identical in the color (hue) of the toners therein, but are different in the color density of the toners therein. That is, the first developing means 4 is filled with developer that is the same in hue, but is lighter in color density (saturation), than the toner in the second developing means 5.

In other words, the image forming apparatus in this embodiment has two developing means, the deep color developing means 5 and light color developing means 4, for each of the four colors, yellow (Y), magenta (M), cyan (C), and black (Bk). The deep color developing means 5 and light color developing means 4 are the same in the hue of the toner of the developer they contain, but are different in the color density (saturation) of the toner of the developer they contain. The color of the toner in the second developing means 5 is darker (deeper) than that in the first developing means 4.

When it is said that two ordinary toners, which are primarily a mixture of resin and coloring component (pigment), are the same in hue, but different in color density (saturation), it usually means that the two toners are practically the same in the spectral characteristics of the coloring ingredient (pigment), but are different in the amount of the coloring component. When one is called "light color toner" of the two toners which are the same in color (hue), it is the one which is lower in color density (saturation).

The image forming apparatus in this embodiment is a system which uses two toners different in color density in order to form a monochromatic toner image of a given color, and the two toners different in color density used for forming a single monochromatic toner image may sometimes be referred to as "dense (dark) toner" and "light toner".

When two toners are said to be the same in hue, it means that the two toners are the same in the spectral characteristics of the coloring component (pigment) as described above. In the following description of the present invention, however, it means that the two toners are the same in terms of the ordinary concept of color, although the two are not exactly the same in hue. For example, two toners may be said to be the same in hue in that both are of magenta, cyan, yellow, or black color.

In the following description of the present invention, when one of the two toners of the same hue is referred to as light color toner, it means that when the amount of this toner deposited on the recording medium is 0.5 mg/cm$^2$, the portion of the recording medium covered with this toner is no more than 1.0 in optical density after the image fixation, whereas the portion of the recording medium covered with the other toner, or the deep color toner (toner more saturated in color), in an amount of 0.5 mg/cm$^2$, is no less than 1.0 in optical density.

In this embodiment, the amount of the pigment in the deep color toner is adjusted so that when the amount of the deep color toner deposited on the recording medium is 0.5 mg/cm$^2$, the optical density of the recording medium covered with this toner is 1.6, whereas that for the light color toner is 0.8. These two toners different in color density (saturation) are used in various ratios to reproduce a desired level (gradation level) of color density.

In terms of the direction, indicated by an arrow mark, in which the photosensitive drum 1 is rotated, the first developing means 4 is located on the upstream side of the second developing means 5.

The normal image forming steps carried out to form an image, by the image forming apparatus structured as described above are as follows:

The charging step to primary transferring step of the image forming process are carried out in each of the processing stations.

First, in each processing station P, the charging step, in which the peripheral surface of the photosensitive drum 1 is uniformly charged by the charging apparatus 2 as a charging means, is carried out.

Meanwhile, in each processing station P, image formation data are read by an image reading portion 20, are processed by a controlling means 15 as the controller for-controlling the image forming operation, and are transmitted to a laser driver 3 (3*a*, 3*b*, 3*c*, and 3*d*), which is a part of the exposing apparatus as a latent image forming means for forming a latent image on the photosensitive drum 1.

In this embodiment, an original is read twice by the original reading portion 20, for each processing station. More specifically, when the original is read for the first time, the obtained image formation data are processed by the controlling means 15 into the video signals for the first developing means 4, whereas when the original is read for the second time, the obtained image formation data are processed by the controlling means 15 into the video signals for the second developing means 5. The flowchart which shows the essential steps of this process of outputting the video signals is given in FIG. 2.

Figure 10:
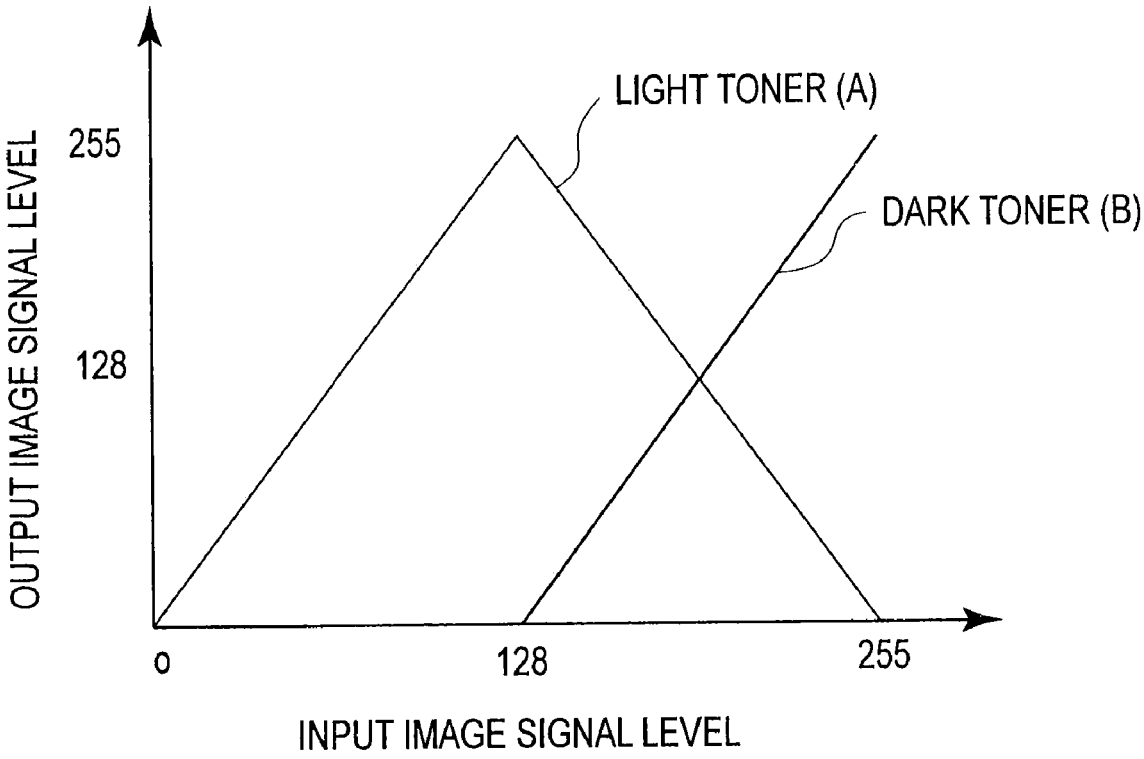
FIG.10 PRIOR ART
FIG. 10 is a graph showing in concept the LUT for the light color toner, and the LUT for the deep color toner, for an image forming apparatus in accordance with the prior art.

First, regarding the first reading of an original for the formation of a latent image (exposure of photosensitive drum 1), the original placed on the original reading portion 20 is scanned (s1), and the optical data obtained from the original are converted (s1) by a CCD 14 into electrical signals, which are converted (s3) by an A/D conversion apparatus into digital signals. The thus obtained digital signals are processed (s4) by the image formation data processing block, and the R, G, and B signals are converted (s5) in color into CMYR signals. Then, the CMYK signals are corrected in the γ property (s6), and are converted. (s7) into the video signals for the light color toner, in accordance with the lookup table (which hereinafter will be referred to as "LUT"). Then, the video signals for the light color toner are digitized (s8). The thus obtained digital image formation data are stored (s9), are converted (s10) into analog signals, are transferred to the laser driver 3, and are used (s11) for image formation. The LUT for the light color toner, which is used in the above described step s7, is represented by the line indicated by a referential letter A, in FIG. 8, as the LUT for the light color toner, for the image forming apparatus in accordance with the prior art, was by a referential letter A in FIG. 10.

The electrostatic latent image formed through the exposure in the above described step (s11) is developed by the first developing means 4 which uses the light color toner. Then, the toner image formed by the first developing means 4 is transferred (primary transfer) onto the intermediary transfer belt 12 by the primary transferring apparatus 7 as a transferring means.

Then, the original is scanned for the second time (s12). In order to form a toner image of the deep color toner after forming a toner image of the light color toner, it is necessary to read (scan) the original again, due to requirement related to the memory. The image formation signals obtained by the second scanning of the original are processed through steps (s12–s17) similar to the steps through which the image formation signals obtained by the first scanning of the original are processed, up to the γ correction step. Thereafter, the signals are converted (s18) into the signals for the deep color toner, in accordance with the LUT for the deep color toner, and then, are digitized (s19). The thus obtained digital image formation data are stored (s20), are converted (s21) into analog signals, are transferred to laser driver 3, and are used to drive (s22) the laser driver 3 to form an image of the deep color toner. The LUT to be used in the step (s18) to obtain the signals for the deep color toner is represented by the line indicated by a letter B, in FIG. 10.

As the above described step s22, or the latent image formation step, is carried out, an electrostatic latent image is formed, through the exposure, on the uniformly charged peripheral surface of the photosensitive drum 1. Next, this electrostatic latent image is developed through the developing step carried out by the second developing means 5 which uses the deep color toner, yielding a toner image formed of the deep color toner. The thus obtained toner image is transferred (primary transfer) by the primary transferring apparatus 7, onto the intermediary transfer belt 12, onto which the toner image formed of the light color toner has been transferred. As a result, a toner image formed of the deep color toner and light color toner is yielded on the intermediary transfer belt 12.

Figure 2:
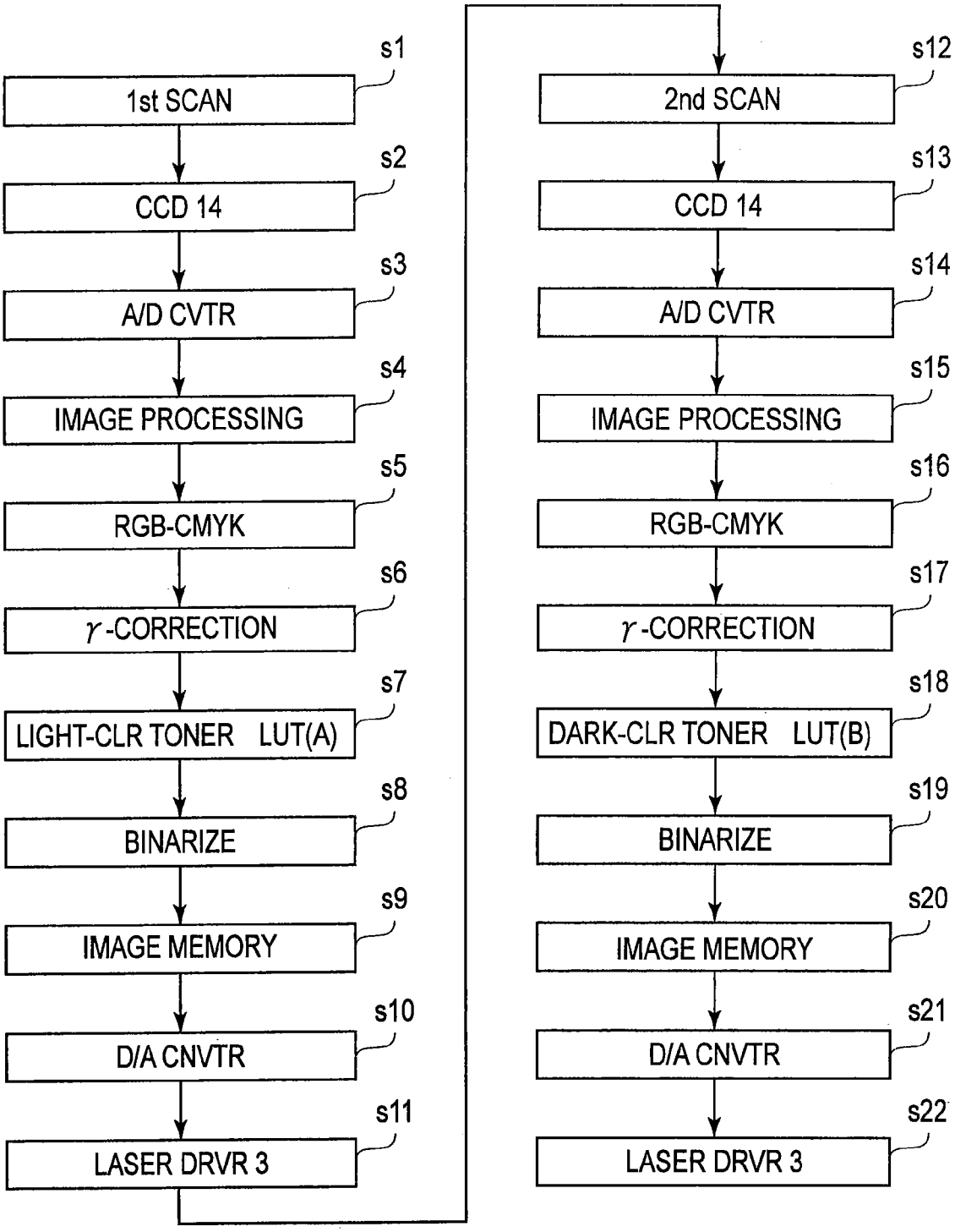
FIG. 2 is a flowchart which shows the flow of video signals in the image forming apparatus in the first embodiment.

In other words, through the video signal processing steps shown in FIG. 2, the original is sorted into the areas which are to be reproduced with the use of only the light color toner, the areas which are to be reproduced with the use of both the light and deep color toners, and the areas which are to be reproduced with the use of only the deep color. Then, it is determined, based on the results of the sorting, whether only one or both of the developing means 4 and 5 are to be used, or which developing means is to be used if only one of the developing means 4 and 5 is to be used.

As for the transferring means, the intermediary transfer member 12 is circularly moved by the suspensive rollers 12*a* and 12*b* at the same speed as the rotational velocity of each of the plurality of photosensitive drums 1, through the contact area (nip) between the primary transferring apparatus 7 and photosensitive drum 1, in each processing station P (Pa, Pb, Pc, and Pd), with its outwardly facing surface, in terms of the loop which the intermediary transfer member 12 forms, kept in contact with the peripheral surface of the photosensitive drum 1. Thus, as the intermediary transfer member 12 is moved sequentially through the plurality of primary transfer stations, the toner image formed on the peripheral surface of the photosensitive drum 1, of the two toner images formed in layers on the peripheral surface of the photosensitive drum 1, which are different in color density, in each processing station P (Pa, Pb, Pc, and Pd) is transferred in layers onto the intermediary transfer member 12. This yields a single multicolor image, which is conveyed, while remaining on the intermediary transfer member 12, to the secondary transfer station 11, by the circular movement of the intermediary transfer member 12.

The multicolor image formed on the intermediary transfer member 12, of the plurality of monochromatic toner images formed of the two toners different in color density, in the plurality of processing stations P, one for one, is transferred (secondary transfer) in the secondary transfer station 11, onto the recording medium p delivered to the secondary transfer station 11 from the sheet feeder cassette 13, and then, is fixed to the recording medium p by the fixing apparatus 9. Thereafter, the recording medium p is discharged as a final product (copy) from the image forming apparatus.

In other words, according to the flowchart given in FIG. 2, the image formation signals are processed, in the step s7, in-accordance with the LUT for the light color toner, so that the areas of the image, which are low in color density, are primarily developed with the light color toner. As a result, the latent image is developed so that a monochromatic image, the low color density areas of which are lower in the color density of each dot, will be yielded. In other words, the flowchart makes it possible to minimize the shortcoming of a digital image in that the digital image appears grainy. Further, another set of image formation signals are processed, in step s18, in accordance with the LUT for the deep color toner. In other words, according to the flowchart in FIG. 2, two monochromatic images different in color density are formed per color component (into which the optical image of the original is separated), through two sets of image formation steps, that is, the image formation signal processing step, latent image forming step, and developing step, and are transferred in layers onto the intermediary transfer belt 12, through the primary transfer step. This yields a single monochromatic image formed of two monochromatic images formed of the deep and light color toners, one for one, which are the same in hue and different in color density.

Described next will be the control to be carried out to form a satisfactory image, regardless of the changes in the apparatus conditions attributable to the usage and the changes in the ambient conditions, through an image forming process such as the one described above, in which two developing means different in the color density of the toners they use are used per color component. In this embodiment, the image forming process is controlled by revising the LUTs used for processing the video signals.

To describe in more detail, the above described image forming apparatus is reset so that the image formation conditions, such as the conditions under which the photosensitive drums 1 are charged and exposed by the image forming means, the conditions under which a latent image is developed, and the conditions under which a toner image is transferred, are set to the defaults. Then, the data for generating the video signals for forming density level detection test patches, which are stored in the ROM or the like, are read by the means for forming the electrostatic latent images for density level detection test, that is, a density level detection test patch forming means, for example, the controller (controlling means) 15, and a desired image density level is inputted. Then, the electrostatic latent image for density level detection test, which reflects the inputted image density level is formed, and is developed by the developing means to be used for developing the latent image in accordance with the intended image. As a result, the image of the density level detection test patch (images to be used for devising LUT) is formed, and is transferred (primary transfer) onto the intermediary transfer medium 12.

Then, the color density level of the toner image of the density level detection test patch on the intermediary transfer member 12 is detected by the density detecting means (density sensor) 21, which is positioned upstream of the second transfer station 11, in terms of the moving direction of the intermediary transfer member 12, so that it faces the intermediary transfer belt 12. The thus obtained density level of the image of the density level detection test patch is used as the output density level. Then, based on the relationship between the inputted color density level, and the outputted color density level detected by the color density sensor 21, the controller 15 as a controlling means revises the image formation conditions, as will be described below, in order to yield a satisfactory image. More specifically, the gradation reference, which in this embodiment is the LUT, set in the video signal processing portion of the controller 15, is revised so that a satisfactory (vivid) image, in terms of gradation, is always formed regardless of the gradational variations.

Figure 3:
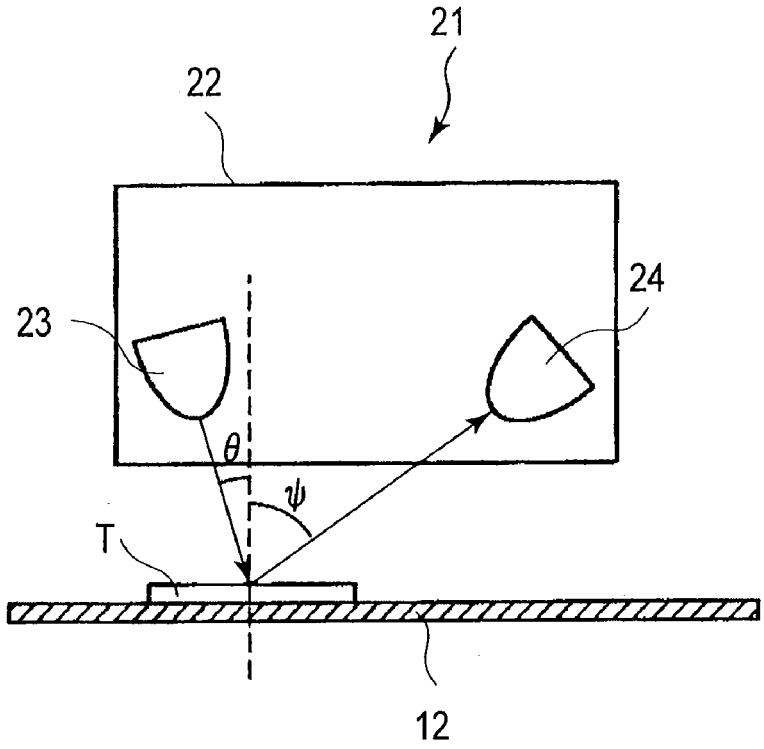
FIG. 3 is a schematic drawing of an-example of a density detecting means in accordance with the present invention, showing the general structure thereof.
Figure 4:
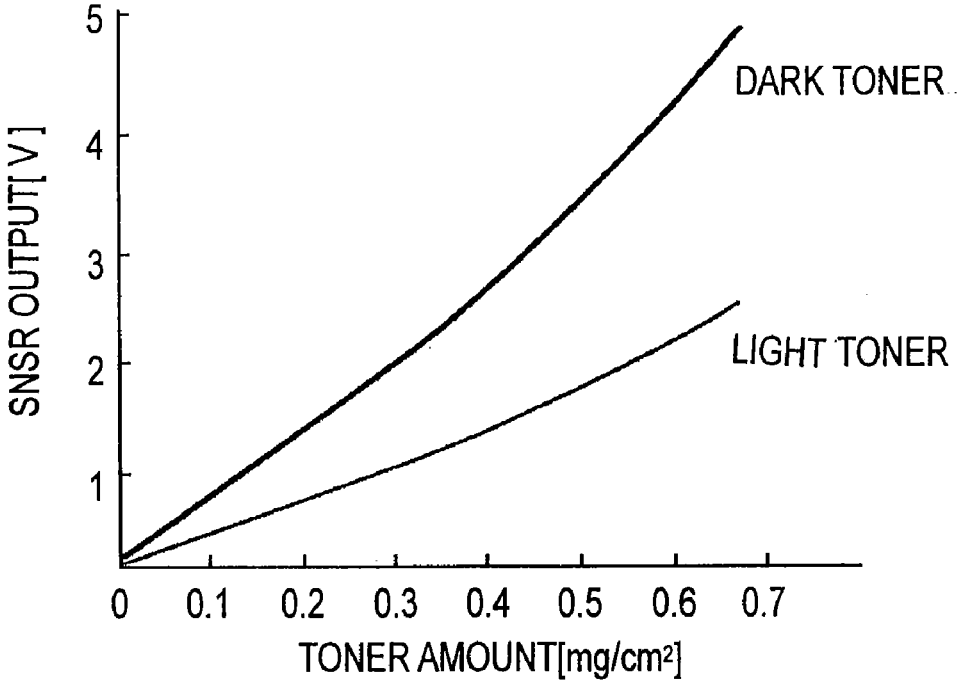
FIG. 4 is a graph showing the relationship between the amount of the light color toner on the medium and the output of the density detecting means, and the relationship between the amount of the deep color toner on the medium and the output of the density detecting means.

Referring to FIG. 3, the density sensor 21 in this embodiment comprises a light emitting element 23, a light receiving element 24 such as a photo-diode, CdS, or the like, and a holder 22 to which the light emitting element 23 and light receiving element 24 are attached. The beam of light from the light emitting element 23 is projected onto the image T of the density level detection test patch (which hereinafter will be referred to patch image T) on the belt 12, and is partially received by the light receiving element 24 after being deflected (diffused) by the patch image T, in order to measure the density level of the patch image T. Generally, light reflected by a given surface includes the portion literally reflected by the surface and the portion diffused by the surface. In this embodiment, a density sensor of the diffuse light type is used as the density sensor 21, and the incident angle $\theta$ and reflection angle $\phi$ are set to 15° and 45°, respectively. The outputs of the density sensor 21 when the light color toner was used, and the outputs of the density sensor 21 when the deep color toner was used, are given in FIG. 4.

The controlling means 15 is enabled to automatically revise the gradation setting, in real time, by changing the values set in the lookup table stored in the $\gamma$ correcting portion of the video signal processing portion, based on, for example, a LUT revision table, in response to the image density (color density) level of the patch image T detected by the density sensor 21.

Figure 5:
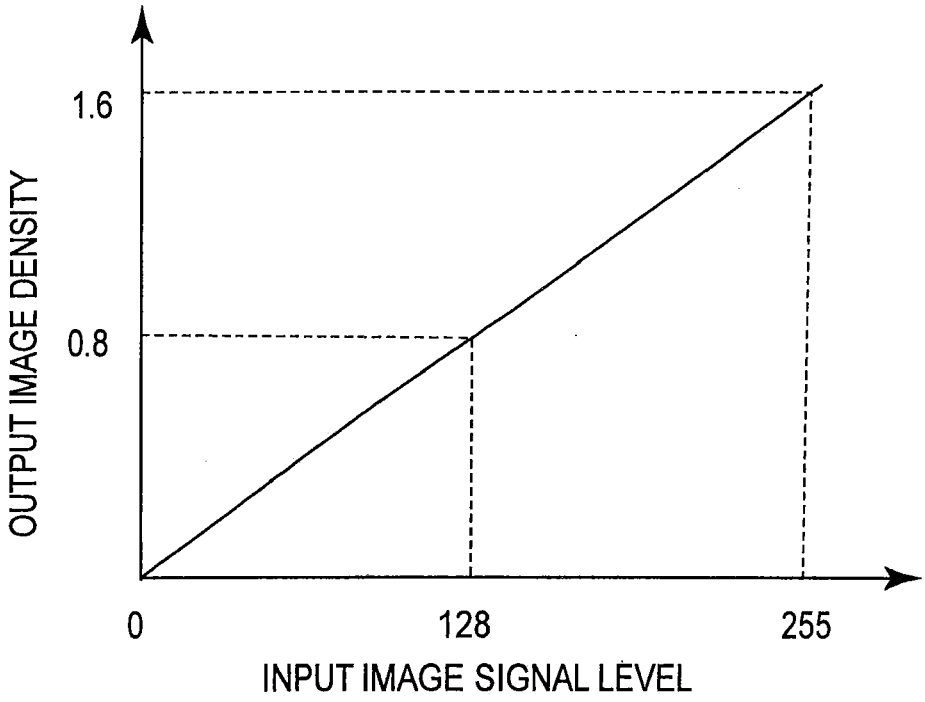
FIG. 5 is a graph showing the relationship between the values of the input video signals, and the density levels of the images resultant from the input video signals, after the adjustment of the input video signals based on the lookup tables.

Further, the controlling means 15 stabilizes the image forming apparatus in terms of image quality, by sequentially revising the image formation conditions, that is, the conditions under which the photosensitive drums 1 are charged, the conditions under which the photosensitive drums 1 are exposed, the conditions under which latent images are developed, the conditions under which images are transferred, etc., which are set in the video signal processing portion. In other words, the controlling means 15 stabilizes the image forming apparatus in terms of image quality by revising the image formation conditions. Since the image forming apparatus is controlled in image density, based on the LUT revised through the above described steps, the relationship between the input video signals and the density level of the image resultant from the inputted video signals becomes linear, as shown in FIG. 5, making it possible to yield an image satisfactory in terms of density level reproduction. Referring to FIG. 5, incidentally, the input video signals means the video signals resulting from the reading of the original by the original reading apparatus 20, and the output image density level means the density level of the image resulting from the input video signals.

As described above, in this embodiment, an image can be formed while controlling the color density by the controlling means in accordance with the LUT.

However, according to the above described image forming process, when the portions of an image, which are in the mid to high range in terms of color density, and which are to be formed of the combination of the light and deep color toners, are formed, the deep color toner is transferred (primary transfer) onto the intermediary transfer belt 12 after the transfer (primary transfer) of the light color onto the intermediary transfer belt 12.

Therefore, the efficiency with which the deep color toner is transfer is affected by the amount of the electrical charge of the light color toner and the amount of the light color toner on the intermediary transfer belt 12. As a result, the density sensor 21 is likely to become inconsistent in terms of its output (color density level). Further, the output of the density sensor 21 is also likely to be affected by how the deep color toner is transferred (primary transfer) in layers onto the light color toner, which is to be transferred (primary transfer) ahead of the deep color toner.

In this embodiment, therefore, the image density values to be inputted for forming the images of the density level detection test patches for revising the LUT are selected by a substantially larger number from the portion of the image density level range, which corresponds to the areas of an image, which are to be formed of the combination of the light and deep color toners, than from the other portion of the image density level range.

Figure 6:
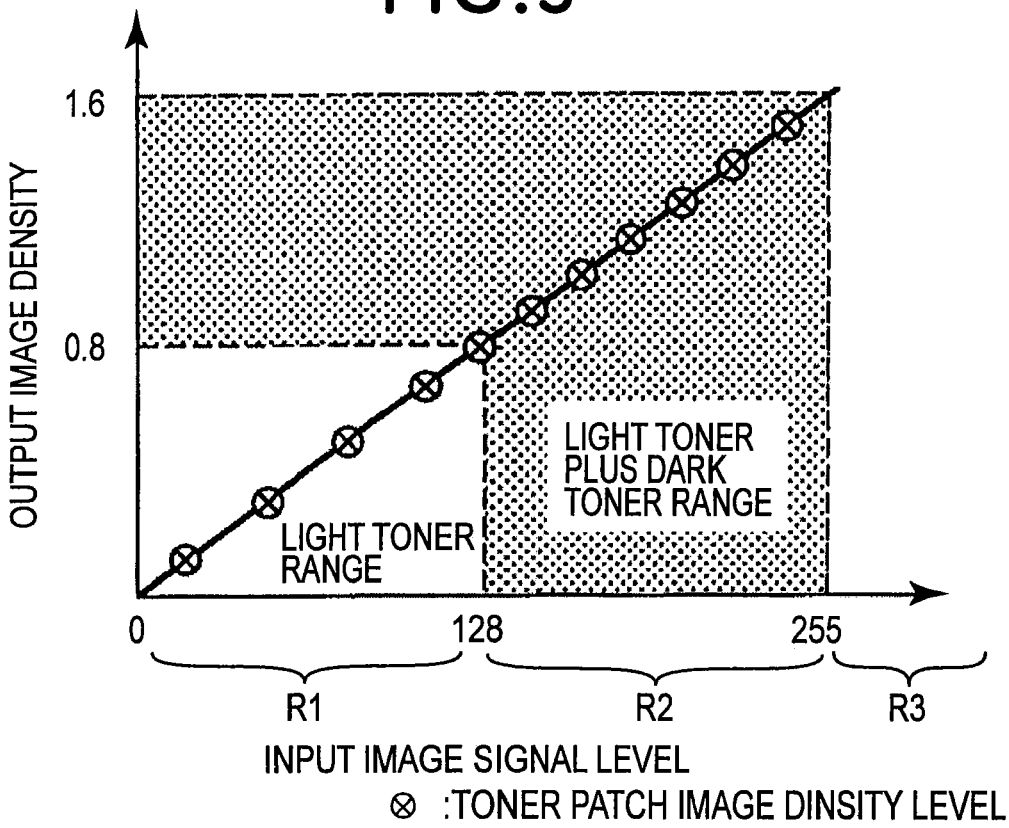
FIG. 6 is a graph showing the relationship between the color density values inputted to form the images of the density level detection test patches, and the density levels of the resultant images of the test patches.

In this embodiment, as the values for the video signals to be inputted to form the patch images for determining the relationship between the input signal level and the output density level, 16, 48, 80, 112, 128, 144, 160, 176, 192, 208, 224, and 240 are selected from among the 255 values used to indicate the density level of an image of a solid color. FIG. 6, in which the abovementioned values for the video signals inputted for patch formation, and the corresponding density levels of the patch images, are plotted, shows the relationship between the input signals and output signals in terms of the image density. As will be evident from this graph, the values for the input video signal are selected so that the interval between the adjacent two selected values is smaller, in the image density level range in which the values are between 128 and 255, than in the other density level range. In other words, the detection of the density level is focused on the density level detection test patches, the density levels of which are between 128 and 255, by increasing the number by which the density level values are selected from the density level range in which the values are between 128 and 255.

More specifically, the abovementioned values are selected in consideration of the following facts (problems). That is, the larger the interval between the adjacent two density level values selected for the density level detection test patches, the more unclear the changes in the γ property, and the less likely to be linear, the relationship between the video signals inputted to form the images of the density level detection test patches, and the density levels of the resultant density level detection test patches detected by the original reading apparatus 20, because of the inconsistency with which the density levels of the test patch images, the density levels of which are in the mid to high range, are detected by the original reading apparatus 20 (equivalent to density level sensor 21. On the other hand, the narrower the interval, the greater the number of the patch images to be formed to detect the relationship between the input video signals and the density level of the resultant image, and, therefore, the longer the down time, or the time spent to detect the relationship, and also, the greater the toner consumption, and, therefore, the higher the image formation cost. As will be evident from the above description, in this embodiment, the density level detection is focused on the mid to high density range.

Therefore, it is necessary to form a larger number of the images of the density level detection test patches, the density levels of which are in the range which includes the mid level, and to detect their density levels.

Referring to FIG. 6, in order to make it easier to understand the abovementioned mid density levels, the overall range of the values for the input video signals are divided into an image density range R1 in which only the light color toner is used, an image density range R2 in which the light and deep color toners are used in combination, and an image density range R3 in which only the deep color toner is used. The abovementioned mid density range in this embodiment means the image density range R2. However, the highest value for the density level is 255. Therefore, the density range R3 is nonexistent.

In other words, the patch images, the theoretical density levels of which fall within the range R2, in which a toner image formed of the deep color toner is transferred onto a toner image formed of the light color toner, are formed by a larger number than the patch images, the theoretical density levels of which do not fall therein, and their actual density levels are detected by the density sensor 21 to minimize the inconsistency with which the density levels of the patch images are detected. Therefore,, it is possible to keep linear the relationship between the input density level and output density level. In other words, it is possible to satisfactorily control the image density.

Incidentally, in the case of an image forming apparatus structured so that the values in the image density range R3 are also used to reproduce desired levels of gradation, it is desired that the patch images, the theoretical density levels of which fall within the image density range R2 (and which are different in theoretical density level) are formed by a greater number than the patch images, the theoretical density levels of which are in the image density range R1 or R2.

This embodiment relates to an image forming apparatus in which each of the plurality of monochromatic images, different in color, formed to form a single multicolor image, is formed of two toners, that is, light and deep color toners, which are the same in hue, but are different in color density, and in which the image density level is controlled by revising the LUT in response to the output of the density sensor 21 which detects the image density levels of the images of the density level detection test patches. As will be evident from the above description of this embodiment, the density level values for forming the patch images, the density levels of which are detected by the density sensor 21 for determining the relationship between a set of input video signals and the resultant image in terms of density level, are selected by a larger number from the portion of the density level range, in which the light and deep color toners are used in combination, than from the other portion of the density level range. Therefore, the transfer efficiency is less affected by the image forming step in which a toner image formed of the deep color toner is transferred onto a toner image formed of the light color toner, on the intermediary transfer belt 12. Therefore, the density detection of the density sensor 21 is less affected by the abovedescribed image forming step. Therefore, the relationship between a set of input video signals and the resultant image remains much closer to being linear. Therefore, the image forming apparatus can yield an image satisfactory in density gradation.

Embodiment 2

Next, referring to FIG. 7, the second embodiment of the present invention will be described.

In this embodiment, the image formation stations Pb and Pc for forming the magenta (M) and cyan (C) images are provided with both the first and second developing means 4 and 5 in the above described first embodiment, and the image formation stations Pa and Pd for forming the yellow (Y) and black (Bk) images are provided with only the second developing means 5, that is, the developing means which uses the deep color toner.

Yellow (Y) color is higher in brightness. Therefore, the graininess of the yellow areas of an image is difficult to visually detect, if the areas are low in density. Thus, the effect of the usage of the light yellow toner is insignificant.

As for black (Bk) color, it is rare that photographic image or the like images, which require high quality, have black areas which are low in density, Further, usually, a letter or the like image is solid. Therefore, effect of the usage of the light black toner is insignificant.

In this embodiment, the process of forming a magenta (M) image and the process of forming a cyan (C) image were controlled in the manner similar to that in the first embodiment. As a result, the relationship between the input video signal and the density level of the resultant image became more linear, across the entire color density range, not only for the monochromatic yellow and black images formed of the deep yellow toner and deep black toner, respectively, but also, for the monochomatic magenta and cyan images formed of the combination of the light and deep magenta toners, and the combination of the light and deep cyan toners, respectively. Therefore, it was possible to form an image satisfactory in terms of density gradation.

Moreover, the component count of the developing means was smaller than that in the first embodiment, and also, the memory capacity necessary for the LUT could be reduced. Therefore, it was possible to provide an image forming apparatus, which was smaller, lower in cost, and simpler to control.

Embodiment 3

Next, referring to FIG. 8, the third embodiment of the present invention will be described. The general structure of the image forming apparatus in this embodiment is the same as that of the image forming apparatus in the first embodiment, and therefore, the same referential numbers and symbols as those used for the designation of the components, means, etc., of the image forming apparatus in the first embodiment are used to designate the corresponding component, means, etc., of this image forming apparatus.

In the first embodiment, the density of the patch image formed to control the image forming apparatus in terms of image density is detected by the density sensor 21 positioned next to the intermediary transfer member 12, facing the intermediary transfer member 12. In this embodiment, however, the density level of the test patch image is detected by the original reading portion 20 after the test patch image is transferred onto the recording medium p, and the control is carried out in response to the thus detected image density level of the test patch image.

Figure 8:
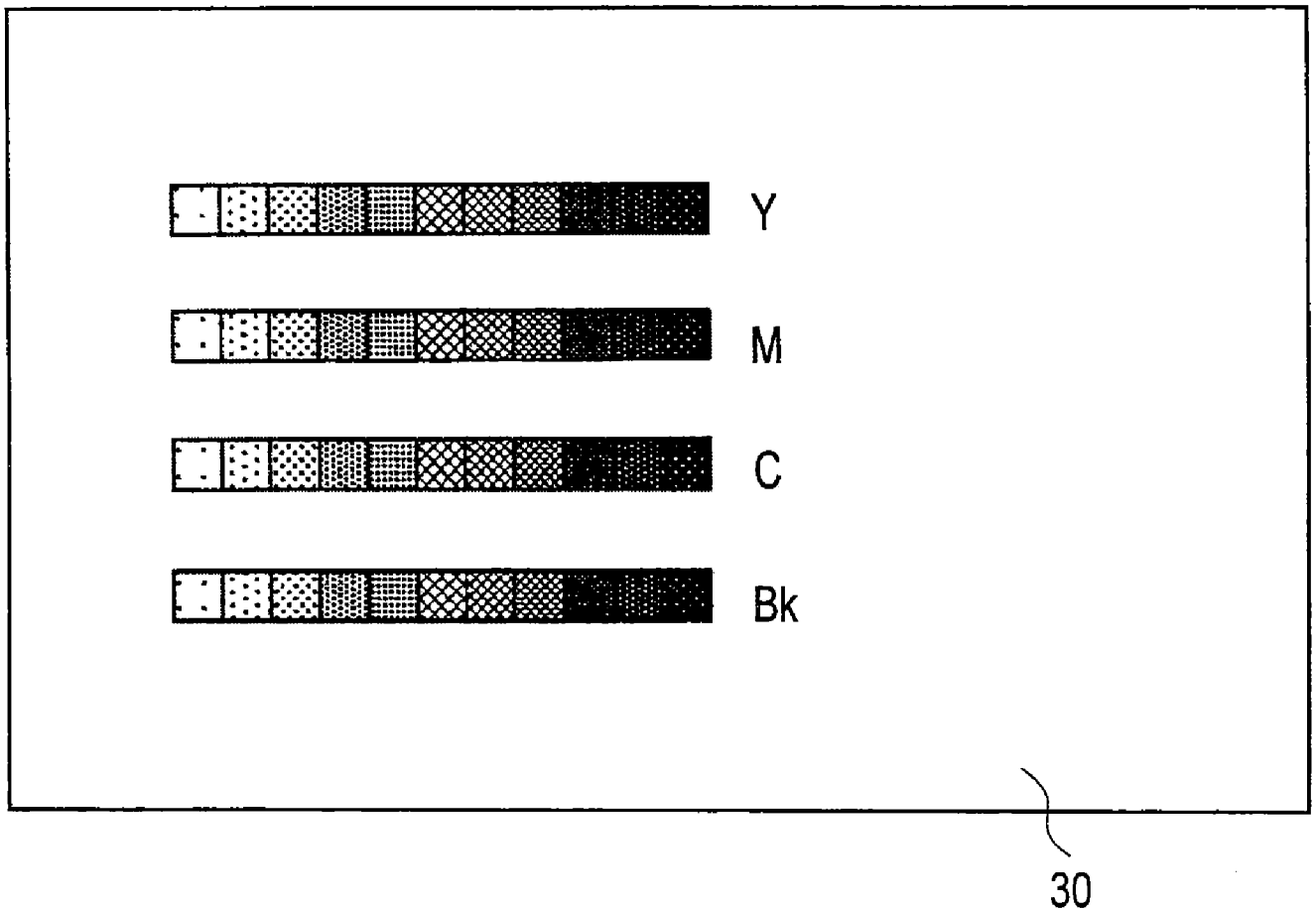
FIG. 8 is a picture of the density level detection test patches in the third embodiment.

Referring, to FIG. 8, a test pattern print 30 contains four rows of color patches, that is, the row of the eleven yellow color patches, row of the eleven magenta color patches, row of the eleven cyan color patches, and row of the eleven black color patches. The eleven color patches in each row of color patches are different in density level (gradation level). Out of the 256 values used to indicate the levels of density (gradation level), which this image forming apparatus is enabled to reproduce, those which correspond to the mid portion of the density level range are primarily selected as the values for forming the density level detection test patches, and the values which correspond to the low and high end portion of the density range are sparsely selected.

Therefore, it is possible to better control the image forming apparatus in terms of the density level, across the transitional range in which the toner used for the formation of a monochromatic image is switched from the light color toner to the combination of the light and deep color toners.

As for the image density levels of the eleven test patches in each of the four rows of test patches, the density level of the test patch, which is deepest in density, is represented by a value of 255 (density level of solid image of deepest color=255), and the values of the selected density levels for the eleven test patches for each color are 16, 48, 80,112, 128, 144, 160, 176, 192, 208, 224, and 240, as they were in the first embodiment. The video signals for forming the images of these eleven test patches, the density levels of which have the above listed values, one for one, are generated with the use of the test patch generating means, without using the LUT.

Also in this embodiment, the central portion of the density level range corresponds to the image density range R2 in which the light and deep color toners are used in combination.

In order to accurately detect the density level of the images of the test patches, the density level of each test patch image was detected at 16 points of the test patch, and the obtained signals are averaged. The value obtained by averaging the 16 values obtained by detecting the density level of each test patch image at 16 different points of the test patch image, and RGB signals are converted by the optical density converting method into the density values for Y, M, C, and Sk. Then, the LUT is revised in response to the thus obtained density values for Y, M, C, and Bk, and a new LUT is set up.

By carrying out the above described image density control, it was possible to reduce the effect of the image forming step, in which a toner image formed of the deep color toner was transferred onto a toner image formed of the light color toner, on the intermediary transfer belt 12, upon the transfer efficiency. Therefore, the output of the density sensor 21 was less affected by the above described image forming step. Therefore, the relationship between a set of input video signals and the density level of the resultant image remained much closer to being linear. Therefore, the image forming apparatus yielded an image satisfactory in density gradation.

Further, the test patch images tested for image density control in this embodiment were the test patch images which had been transferred onto the recording mediums p, and had been fixed to the recording mediums p by being put through the fixing device 9. Therefore, they were virtually the same in terms of image density level as that of the image to be formed for actual usage. Thus, the image density control in this embodiment was more accurate than that in the first embodiment.

Figure 7:
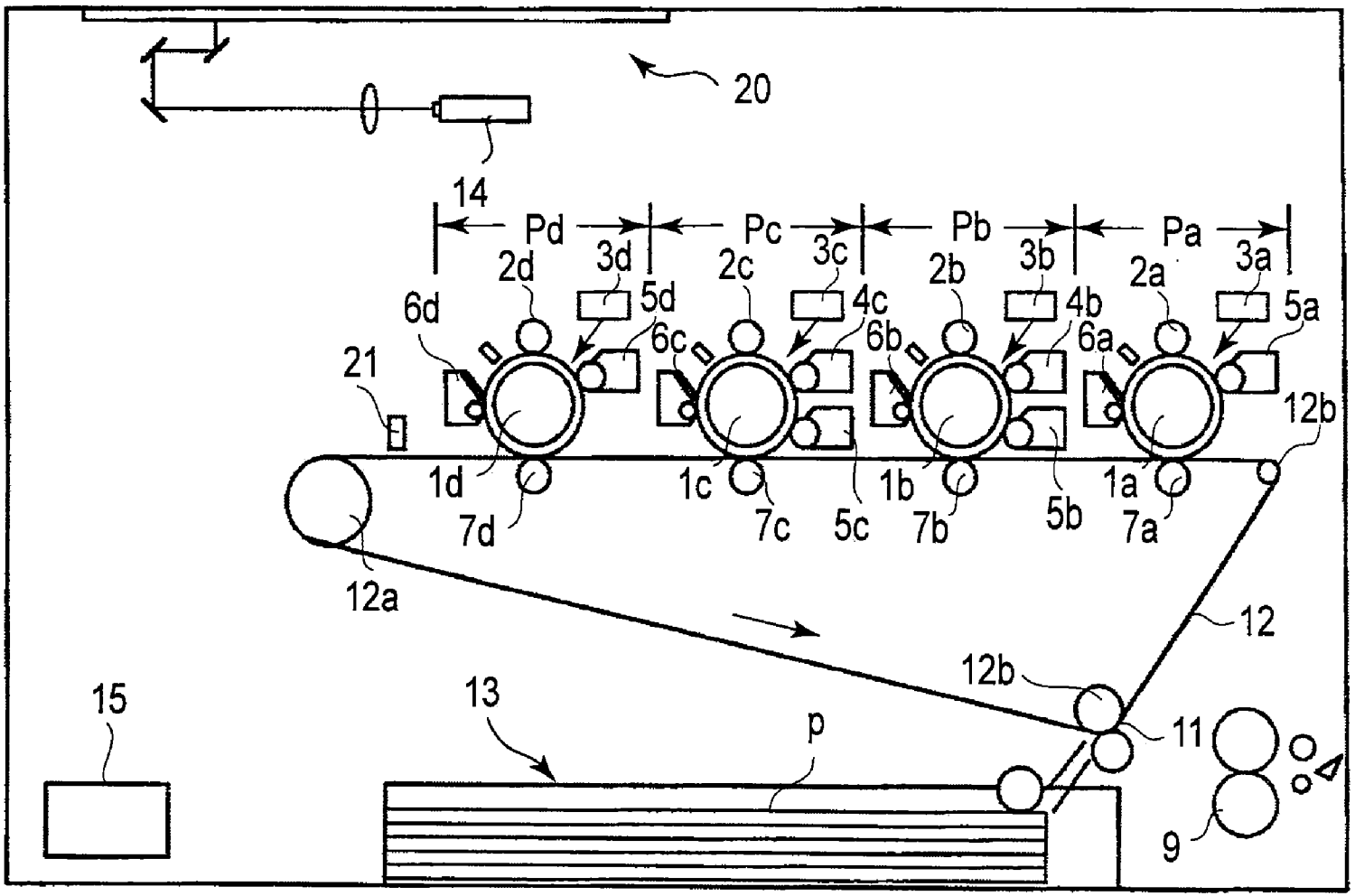
FIG. 7 is a schematic drawing showing the general structure of the image forming apparatus in the second embodiment.

Referring to FIGS. 1 and 7, in the first to third embodiments, the density sensor 21 was positioned so that it faced the intermediary transfer member 12, which was a transfer belt for a multilayer direct image transfer method. Obviously, however, the density sensor 21 may be positioned so that it faces the peripheral surface of the photosensitive drum 1. Placing the density sensor 21 so that it faces the peripheral surface of the photosensitive drum 1 is just as effective as placing the density sensor 21 so that it faces the intermediary transfer member 12.

Embodiment 4

Figure 9:
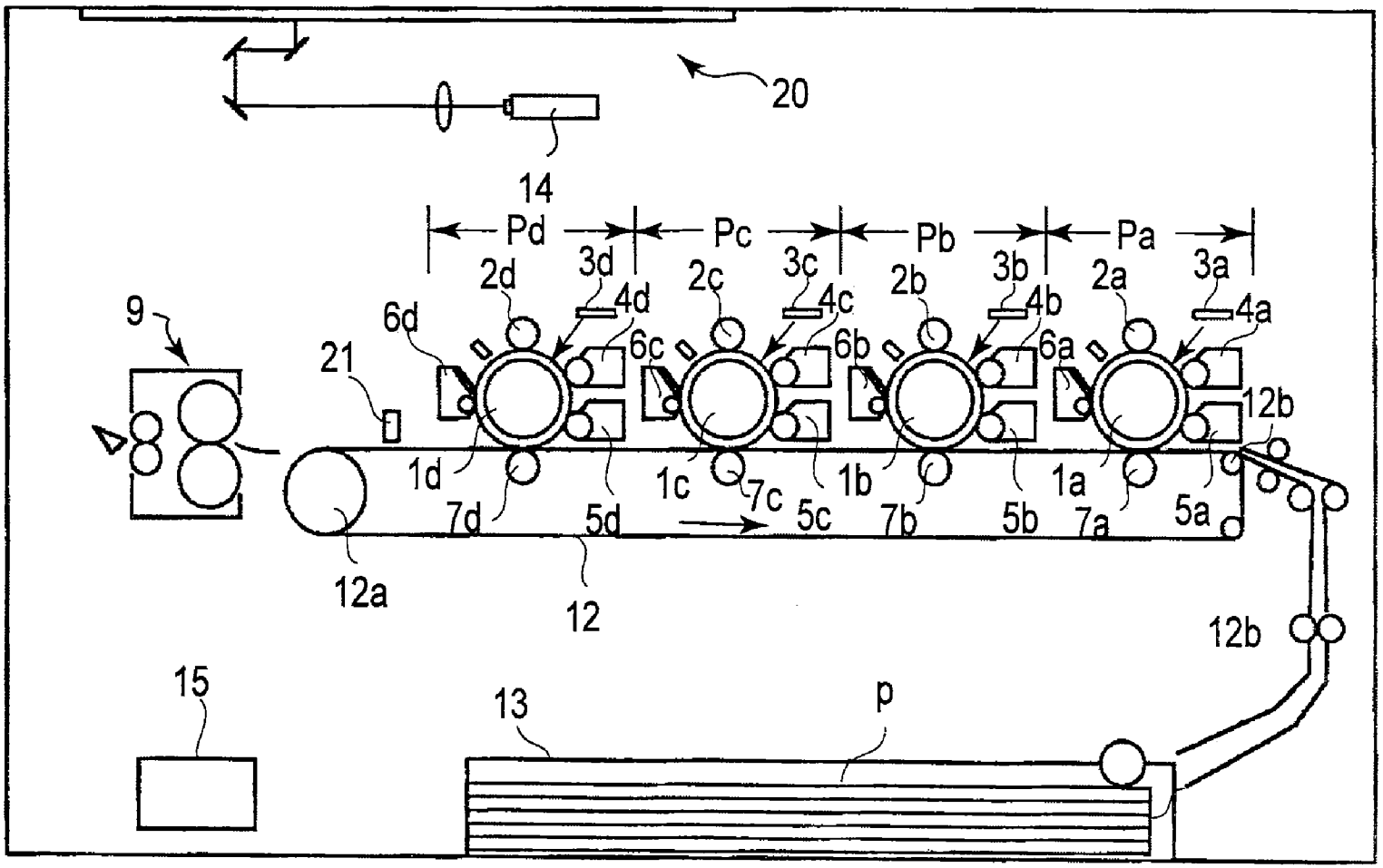
FIG. 9 is a schematic drawing of the image forming apparatus in the fourth embodiment, showing the general structure thereof.

Next, referring to FIG. 9, the fourth embodiment of the present invention will be described.

This embodiment is an example of the application of the present invention to an image forming apparatus employing the multilayer direct image transferring method. In this embodiment, a plurality of image formation stations Pa–Pd, similar in structure as those shown in FIG. 1, are disposed along the transfer belt 12. The recording medium p from a cassette 13 is borne on the surface of the transfer belt 12, and is conveyed by the transfer belt 12 through the image formation stations Pa–Pd, in which it remains pinched between the transfer roller 7, and the photosensitive drum 1, so that the a plurality of monochromatic toner images are transferred in layers directly onto the recording medium p. After the direct transfer, the recording medium p is conveyed through the fixing device 9, in which the plurality of monochromatic toner images on the recording medium p are fixed. Thereafter, the recording medium p is discharged from the image forming apparatus.

In this embodiment, the images of the density level test patches are formed on the portion of the transfer belt 12 other than where the recording medium P is borne, or on the recording medium p borne on the transfer belt 12. Then, the test patch images are tested for density level by the density sensor 21. The image control in this embodiment is the same as those in the abovedescribed first to third embodiments.

According to the abovedescribed first to fourth embodiments, it is possible to keep linear the relationship between the input video signals and the density levels of the resultant images, even if the condition of an image forming apparatus changes because of the formation of a large number of images, and/or the ambient conditions change. Therefore, it is possible to always form images of high quality.

Incidentally, in the above, the first to fourth embodiments were described with reference to an image forming apparatus of an inline type. However, the number of photosensitive drums 1 does not need to be limited to the number in these embodiments. For example, a plurality of developing means may be disposed adjacent to the peripheral surface of a single photosensitive drum.

Further, the measurements, materials, and shapes of the structural components of the image forming apparatus, and the positional relationship among them, in the first to fourth embodiments of the present invention, are not intended to limit the scope of the present invention, unless specifically noted.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 434003/2003 filed Dec. 26, 2003, which is hereby incorporated by reference.

What is claimed is:

1. An image forming apparatus comprising:

image forming means for forming a toner image using light color toner and dark color toner, which have the same hues and which have different densities, wherein said image forming means effects image formation using only the light color toner in a first image density region and effects image formation using both of the light color toner and the dark color toner in a second image density region;

test image forming means for operating said image forming means to form, using the light color toner and the dark color toner, a plurality of test patterns, which have different densities, for density control, wherein the test patterns formed by said test image forming means using said image forming means include groups of test patches at density difference intervals which are smaller in the second image density region than in the first image density region;

detecting means for detecting the test patterns; and control means for controlling an image forming condition of said image forming means in accordance with an output of said detecting means.

2. An apparatus according to claim 1, wherein said image forming means includes a photosensitive member on which a toner image is formed through an electrophotographic process, and transferring means for transferring the toner image from said photosensitive member onto a recording material.

3. A control method for controlling an image forming condition of an image forming apparatus capable of forming a toner image using light color toner and dark color toner, which have the same hues and which have different densities, and forming an image using only the light color toner in a first image density region and forming an image using both of the light color toner and the dark color toner in a second image density region, said method comprising:

a step of forming, using the light color toner and the dark color toner, a plurality of test patches, which have different densities, for density control, wherein a group of test patches are formed in the second image density region at density difference intervals which are smaller than density difference intervals in the first image density region;

a step of detecting a density of the test patches; and a step of controlling the image forming condition on the basis of a result of said detecting step.

* * * * *

UNITED STATES PATENT AND TRADEMARK OFFICE

CERTIFICATE OF CORRECTION

PATENT NO. : 7,206,531 B2
APPLICATION NO. : 11/018859
DATED : April 17, 2007
INVENTOR(S) : Suzuki et al.

It is certified that error appears in the above-identified patent and that said Letters Patent is hereby corrected as shown below:

IN THE DRAWINGS:
Sheet No. 4, Figure 6, “DINSITY” should read --DENSITY--.

COLUMN 2:
Line 53, “an-example” should read --an example--.

COLUMN 3:
Line 26, “Stations” should read --stations--.
Line 32, “drum l” should read --drum 1--.

COLUMN 4:
Line 63, “for-controlling” should read --for controlling--.

COLUMN 5:
Line 21, “CMYR signals.” should read --CMYK signals.--.

COLUMN 6:
Line 51, “in-accordance” should read --in accordance--.

COLUMN 8:
Line 33, “means” should read --mean--.

COLUMN 10:
Line 8, “are” should read --be--.

UNITED STATES PATENT AND TRADEMARK OFFICE

CERTIFICATE OF CORRECTION

PATENT NO. : 7,206,531 B2
APPLICATION NO. : 11/018859
DATED : April 17, 2007
INVENTOR(S) : Suzuki et al.

It is certified that error appears in the above-identified patent and that said Letters Patent is hereby corrected as shown below:

COLUMN12:
Line 7, "and Sk." should read --and Bk.--.

Signed and Sealed this

Seventeenth Day of February, 2009

JOHN DOLL
*Acting Director of the United States Patent and Trademark Office*